US006001433A

United States Patent [19]

Meng

[11] Patent Number: 6,001,433

[45] Date of Patent: Dec. 14, 1999

[54] MOTION ORNAMENT

[76] Inventor: Sally Meng, P.O. Box 82-144, Taipei, Taiwan

[21] Appl. No.: 09/144,446

[22] Filed: Sep. 1, 1998

[51] Int. Cl.[6] ..... G09F 19/00

[52] U.S. Cl. ..... 428/13; 40/406; 40/414; 446/267

[58] Field of Search ..... 40/406, 414; 446/267; 428/13

*Primary Examiner*—Alexander Thomas

*Attorney, Agent, or Firm*—A & J

[57] ABSTRACT

A motion ornament includes a base, a transparent spherical shell mounted on the base at the top and holding a liquid on the inside, an ornament suspended in the liquid within the transparent spherical shell, a musical box mounted within the base and controlled to produce a music, a reciprocating mechanism coupled between the pinned barrel of the musical box and the ornament to reciprocate the ornament in the liquid within the transparent spherical shell upon the operation of the musical box.

1 Claim, 4 Drawing Sheets

MOTION ORNAMENT

BACKGROUND OF THE INVENTION

The present invention relates to a motion ornament, and more specifically to such a motion ornament which couples an ornament, which is suspended in a liquid within a transparent spherical shell, to the pinned barrel of a musical box through a reciprocating mechanism, enabling the ornament to be reciprocated vertically in the liquid within the transparent spherical shell upon operation of the musical box.

Various artificial ornamental crystal balls have been disclosed, and have appeared on the market. These artificial ornamental crystal balls commonly comprise a base, a transparent spherical shell mounted on the base and holding a liquid, and ornaments suspended in the liquid within the transparent spherical shell. When light passes through the transparent spherical shell, light rays are refracted by the liquid in different directions, causing a lighting effect to be produced. Further, the transparent spherical shell and the liquid work as a magnifier that magnifies the ornaments. These ornamental crystal balls are less attractive because they are of static design.

SUMMARY OF THE INVENTION

According to one aspect of the present invention, the motion ornament comprises a base, a transparent spherical shell mounted on the base at the top and holding a liquid on the inside, an ornament suspended in the liquid within the transparent spherical shell, a musical box mounted within the base and controlled to produce a music, a reciprocating mechanism coupled between the pinned barrel of the musical box and the ornament to reciprocate the ornament in the liquid within the transparent spherical shell upon the operation of the musical box. According to another aspect of the present invention, the transparent spherical shell has an opening sealed with a flexible packing member, and a water-sealing bellows sleeve is sleeved onto a vertical support rod of the driving unit and connected between the ornament and the flexible packing member to stop the liquid from leaking out of the transparent spherical shell.

DETAILED DESCRIPTION OF THE PREFERRED EMBODIMENT

Figure 1:
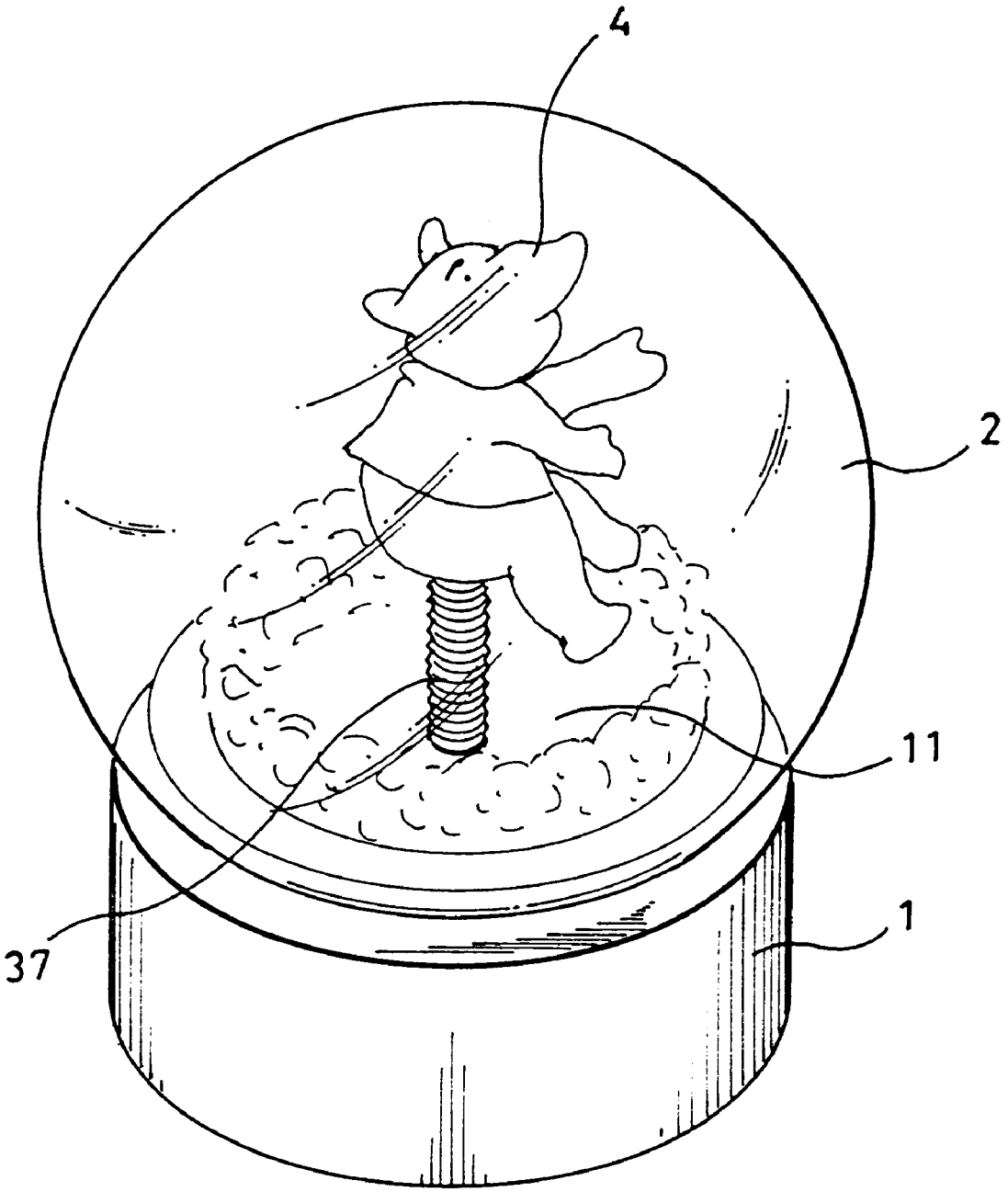
FIG. 1 is a perspective view of a motion ornament according to the present invention.
Figure 2:
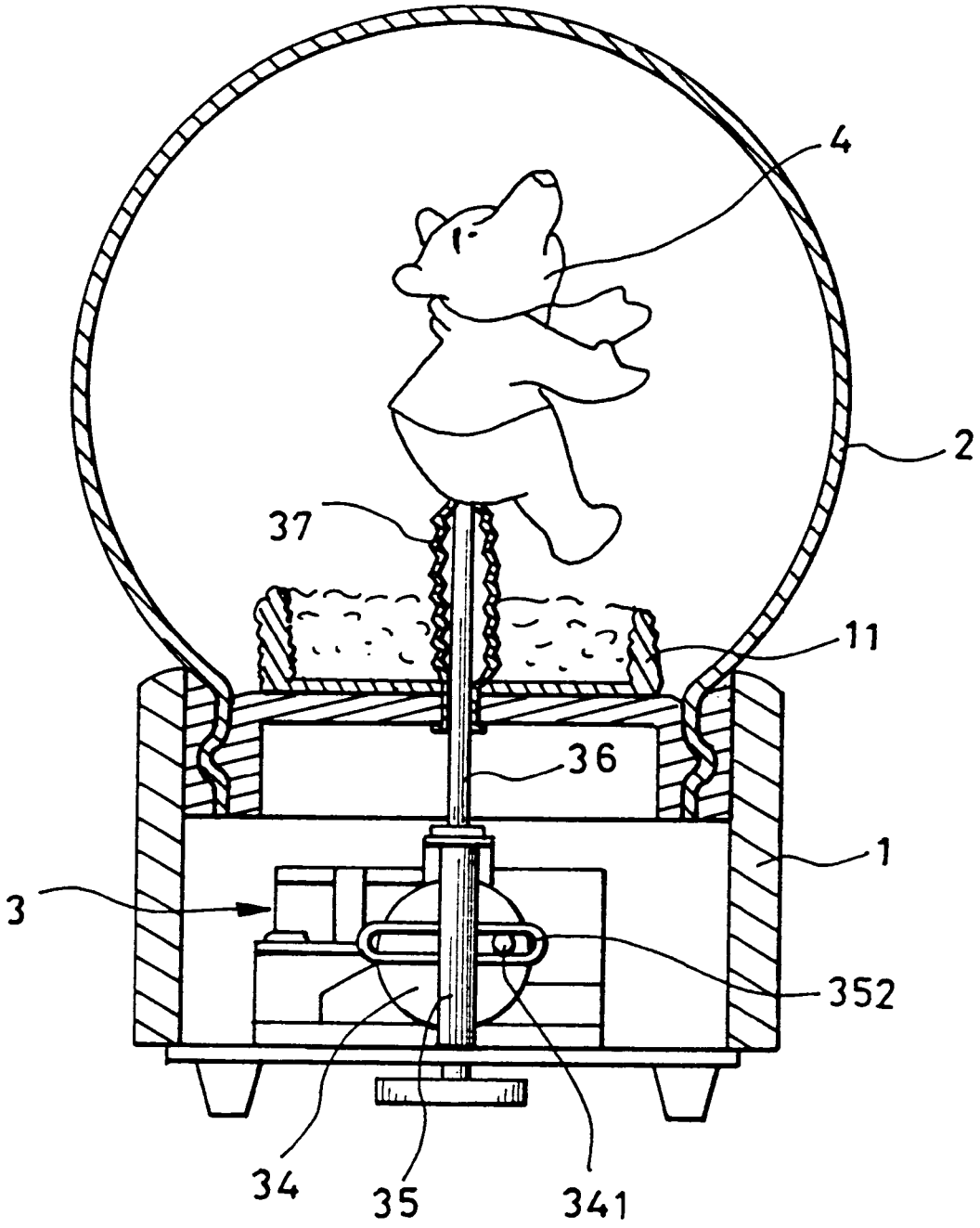
FIG. 2 is a sectional view of the motion ornament shown in FIG. 1.

Referring to FIGS. 1 and 2, a motion ornament in accordance with the present invention is generally comprised of a base 1, a transparent spherical shell 2, a driving unit 3, and an ornament 4.

Figure 3:
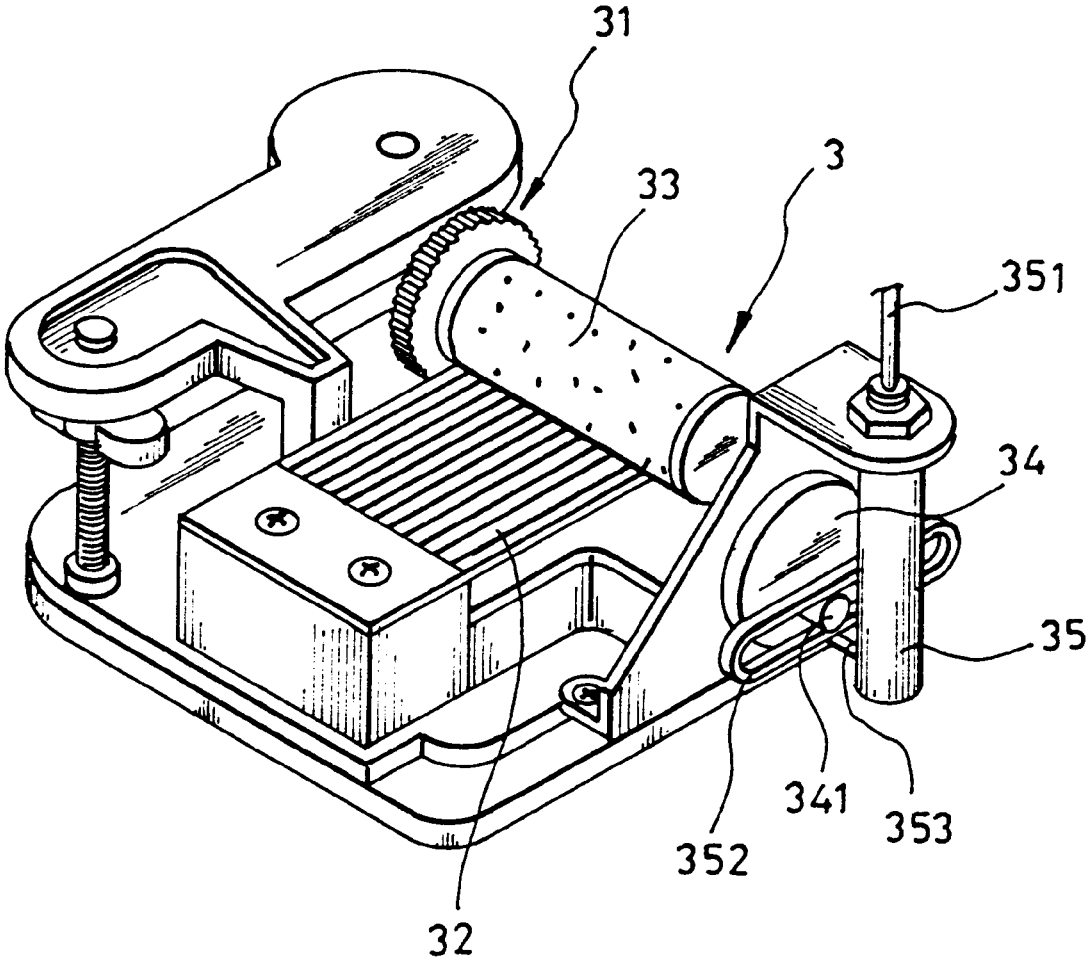
FIG. 3 is a perspective view of the driving unit for the motion ornament according to the present invention.

Referring to FIG. 3 and FIGS. 1 and 2 again, the base 1 is a hollow member holding the driving unit 3 on the inside and the transparent spherical shell 2 at the top above the driving unit 3. The transparent spherical shell 2 has a bottom opening sealed with a flexible packing member 11, and fixedly secured to the base 1 at the top. The ornament 4 is suspended in a liquid filled in the transparent spherical shell 2, The driving unit 3 comprises a driving mechanism 31 (a clockwork or motor), a metal comb 32, a pinned barrel (reproducer) 33, which is turned by the driving mechanism 31 relative to the metal comb 32 and forms with the driving mechanism 31 and the metal comb 32 a musical box, a rotary wheel 34 coupled to the shaft of the pinned barrel 33 at one end and disposed in vertical , an eccentric rod 341 raised from the rotary wheel 34 at one side at an eccentric location, a fixed cylinder 35 spaced from the rotary wheel 34 at one side, the cylinder 35 has a longitudinal sliding slot 350, a vertical reciprocating rod 351 inserted into the cylinder 35 and vertically moved in and out of the top end of the cylinder 35, a bottom horizontal rod 353 perpendicularly connected to the bottom end of the vertical reciprocating rod 351 and extended out of the longitudinal sliding slot 350, a coupling member 352 integral with the bottom horizontal rod 353 and coupled to the eccentric rod 341 by a slip joint, a top horizontal rod 3511 perpendicularly connected to the top end of the vertical reciprocating rod 351 above the top end of the fixed cylinder 35, a vertical support rod 36 having a bottom end fixedly connected to one end of the top horizontal rod 3511 remote from the vertical reciprocating rod 351 and a top end inserted through a hole on the flexible packing member 11 and connected to the ornament 4, and a water-sealing bellows sleeve 37 mounted around the vertical support rod 36 and connected between the ornament 4 and the flexible packing member 11 to stop water from leaking out of the transparent spherical shell 2.

Figure 4:
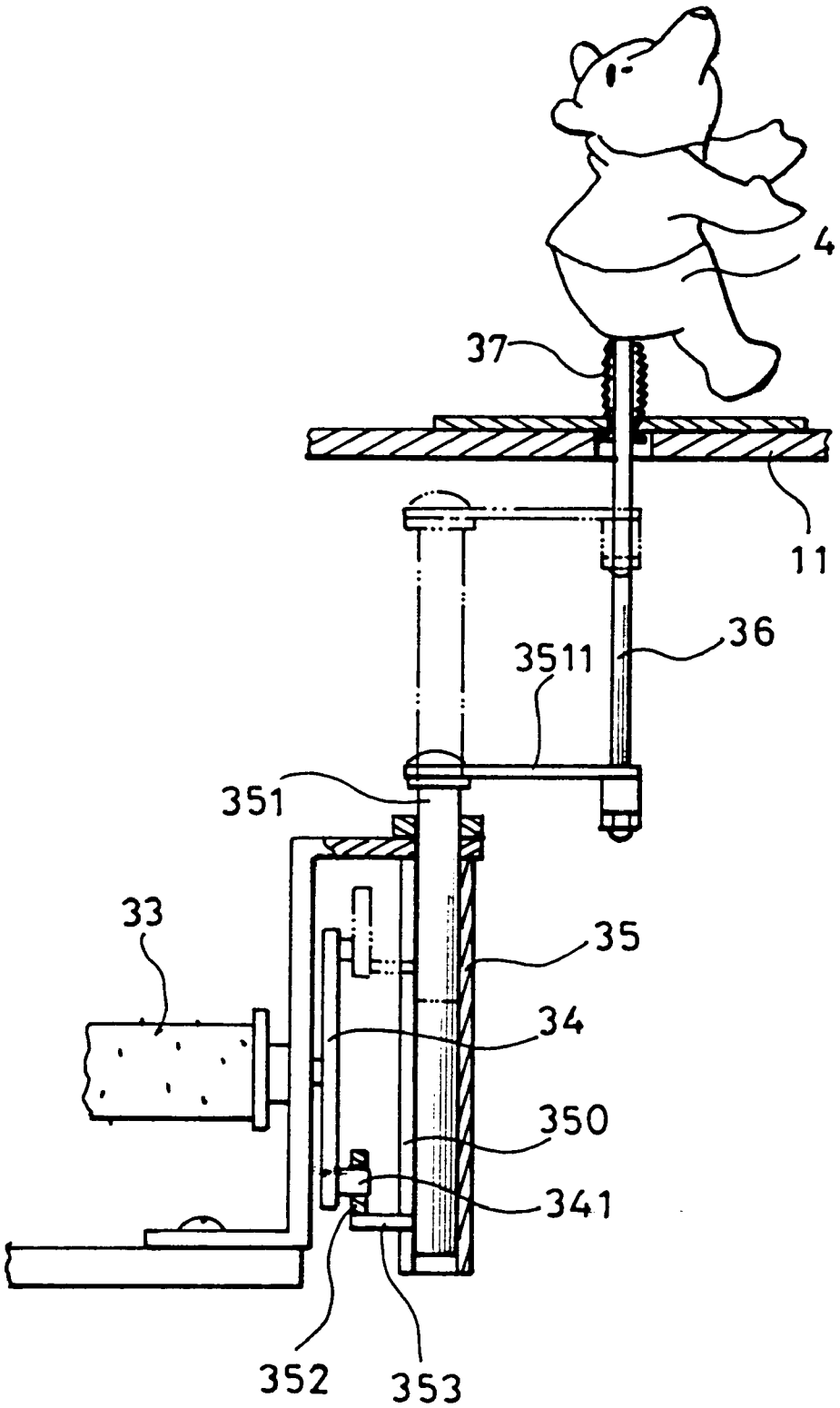
FIG. 4 is a sectional plain view showing the operation of the driving unit according to the present invention.

Referring to FIG. 4 and FIG. 2 again, when the driving mechanism 31 is started to rotate the pinned barrel 33 against the metal comb 32, a music is produced, and at the same time the rotary wheel 34 is turned with the pinned barrel 33, causing the bottom horizontal rod 352 to be reciprocated along the longitudinal sliding slot 350, and therefore the vertical support rod 36 is moved with the top horizontal rod 3511 and the vertical reciprocating rod 351 up and down and the ornament 4 is reciprocated vertically in the liquid within the transparent spherical shell 2.

While only one embodiment of the present invention has been shown and described it will be understood that the drawings are designed for purposes of illustration only, and are not intended as a definition of the limits and scope of the invention disclosed.

What the invention claimed is:

1. A motion ornament comprising:

a base having a flexible packing member at a top side thereof;

a transparent spherical shell mounted on said flexible packing member above said base, said transparent spherical shell holding a liquid;

an ornament suspended in the liquid inside said transparent spherical shell;

a driving unit mounted within said base below said flexible packing member and operated to reciprocate said ornament vertically in the liquid inside said transparent spherical shell, said driving unit comprising a driving mechanism, a rotary wheel rotated by said driving mechanism, an eccentric rod raised from said rotary wheel at one side, a fixed cylinder spaced from said rotary wheel at one side, said fixed cylinder having a longitudinal sliding slot, a reciprocating rod moved in said fixed cylinder, said reciprocating rod having a bottom end inserted into said fixed cylinder and a top end extended out of said fixed cylinder, a bottom horizontal rod perpendicularly connected to the bottom end of said vertical reciprocating rod and extended out of said longitudinal sliding slot, a coupling member integral with said bottom horizontal rod and coupled to said eccentric rod by a slip joint for enabling said bottom horizontal rod to be moved up and down along said longitudinal sliding slot when said rotary wheel is rotated by said driving mechanism, a top horizontal rod perpendicularly connected to the top end of said vertical reciprocating rod above said fixed cylinder, a vertical support rod having a bottom end fixedly connected to one end of said top horizontal rod remote from said vertical reciprocating rod and a top end inserted through a hole on said flexible packing member and connected to said ornament, and a water-sealing bellows sleeve mounted around said vertical support rod and connected between said ornament and said flexible packing member to stop said liquid from leaking out of said transparent spherical shell.

* * * * *